US010206446B1

(12) United States Patent
Delay

(10) Patent No.: US 10,206,446 B1
(45) Date of Patent: Feb. 19, 2019

(54) VISOR FOR PROTECTION OF FACE AND NECK AGAINST SUNLIGHT

(71) Applicant: Margaret Delay, Nantucket, MA (US)

(72) Inventor: Margaret Delay, Nantucket, MA (US)

( * ) Notice: Subject to any disclaimer, the term of this patent is extended or adjusted under 35 U.S.C. 154(b) by 142 days.

(21) Appl. No.: 15/605,301

(22) Filed: May 25, 2017

Related U.S. Application Data

(60) Provisional application No. 62/355,262, filed on Jun. 27, 2016.

(51) Int. Cl.
*A42B 1/18* (2006.01)
*A42B 3/22* (2006.01)
*A42B 1/06* (2006.01)

(52) U.S. Cl.
CPC ..... *A42B 1/18* (2013.01); *A42B 1/062* (2013.01); *A42B 3/227* (2013.01)

(58) Field of Classification Search
CPC ..... A42B 1/18; A42B 1/062; A42B 3/227; A42B 1/00; A42B 1/206; A42B 1/064; A42B 3/18; A42B 3/20; A42B 3/22; A42B 3/222; A42B 3/223; A42B 5/00
See application file for complete search history.

(56) References Cited

U.S. PATENT DOCUMENTS

| | | | |
|---|---|---|---|
| 1,532,317 | A | 4/1925 | Kingsbury |
| 1,598,313 | A | 8/1926 | Rosenberg |
| 1,677,187 | A | 3/1927 | Leibson |
| 2,651,044 | A | 9/1953 | Stankiewicz |
| 2,855,604 | A | 10/1958 | Austin |
| 4,023,212 | A | 5/1977 | Huffman |
| 4,547,903 | A | 10/1985 | Brown |
| 4,793,006 | A | 12/1988 | Dawson |
| 4,821,341 | A | 4/1989 | Baptiste |
| 4,993,081 | A | 2/1991 | Fulghum |
| 5,012,528 | A | 5/1991 | Pernicka |
| 5,091,995 | A | 3/1992 | Oates |
| 5,253,364 | A | 10/1993 | Robinson |
| 5,471,684 | A | 12/1995 | Casale |
| 5,533,211 | A | 7/1996 | Mehrens |
| D379,679 | S | 6/1997 | Poole |
| 5,647,060 | A | 7/1997 | Lee |
| 5,669,071 | A | 9/1997 | Vu |
| 5,689,830 | A | 11/1997 | Pflum |
| 5,704,062 | A | 1/1998 | Caroleo |
| 5,862,523 | A | 1/1999 | Proctor |
| 5,898,935 | A | 5/1999 | Davis |
| 6,029,272 | A | 2/2000 | Bazin |
| 6,260,204 | B1 | 7/2001 | Morrissey |
| 6,484,323 | B1 | 11/2002 | Pu |
| 7,082,618 | B1 | 8/2006 | Muso |
| D529,262 | S | 10/2006 | Yan |
| 7,137,146 | B2 | 11/2006 | Yan |
| 7,406,721 | B2 | 8/2008 | Husbands |
| 8,020,218 | B2 | 9/2011 | Stingone |
| 9,149,085 | B2 | 10/2015 | Bryan |

(Continued)

FOREIGN PATENT DOCUMENTS

| | | | |
|---|---|---|---|
| DE | 102004018053 | A1 | 11/2005 |

*Primary Examiner* — Steven O Douglas
(74) *Attorney, Agent, or Firm* — Keeley DeAngelo LLP; W Scott Keeley

(57) ABSTRACT

A wearable sun-shade consisting of a headband with an adjustable, sliding visor. The visor attaches to the headband via a combination ball joint and sliding linear-motion guide. The visor slides and pivots along the length of the headband so as to shade specific areas of the face and neck.

12 Claims, 11 Drawing Sheets

(56) References Cited

U.S. PATENT DOCUMENTS

| | | | |
|---|---|---|---|
| 9,226,538 | B2 | 1/2016 | Kim |
| 9,591,885 | B2 | 3/2017 | Cheng |
| 2002/0004946 | A1 | 1/2002 | Nelson |
| 2004/0040067 | A1 | 3/2004 | Pong |
| 2015/0351966 | A1 | 6/2015 | McCauley |
| 2018/0110282 | A1 | 4/2018 | Zhang |

VISOR FOR PROTECTION OF FACE AND NECK AGAINST SUNLIGHT

TECHNICAL FIELD

The presently-disclosed subject matter relates to headbands and head coverings used for shading the face and neck from the sun.

BACKGROUND

An abundance of hats and headbands are made to shade one's face and neck from the sun. They include ball caps; soft and hard visors; hard-hats with composite and accessory visors; attachable brims; and headbands with visors, some of which are adjustable in a singular direction. In the existing art adjustments are usually limited to lateral or medial adjustment of the visor, bringing it higher or lower on one's brow, or across the face, to shade it from sunlight. Existing art also is limited to simple adjustments of the visor's placement on one's head.

The present disclosure relates to head coverings and headbands with visors that shade the head, face and neck from the sun.

SUMMARY

The present embodiment describes a wearable sun-shade comprising a headband and an adjustable, sliding visor that shades the face and neck from sunlight. The separable visor attaches to the headband via a sliding coupling-mechanism. In one embodiment the headband is configured with a groove along a substantial length of the headband. The groove is larger on the inside than the long opening, and is often referred to as a T-slot for the way that an object shaped like a capital letter 'T' would fit inside the slot. A 'T' shaped bracket is able to move along the slot without falling out. The T-shaped fits inside the T-slot and has a ball that fits in a socket that is mounted to the visor, and so allows placement of the visor on various locations along the headband, the headband functioning as a sliding rail. The visor slides into various positions to shade any part of the head and neck, depending on the direction of the sunlight. In addition, the sliding mechanism with the aforementioned ball and socket makes up a ball joint that allows pivoting of the visor at various angles to block the sun on parts of the face and neck. The visor both slides and pivots, offering two planes of lateral adjustment, giving unlimited angles to position the shade so as to provide shade for the face and neck.

In other embodiments the headband has a T-shaped rail affixed to it. The T-shaped rail mates with a bracket having a T-shaped through-hole that fits over the T-shaped rail, thus allowing for sliding linear motion of the bracket substantially about the length of the headband. The bracket having a ball that mates with a socket mounted to the visor. In some embodiments the socket is mounted directly to a plastic visor, while in other embodiments the socket is mounted to a support structure that is in turn affixed to the visor. One skilled in the art understands that the ball and socket in this system are interchangeable and that a ball may be mounted to the visor while the socket is mounted to a bracket that slides along a linear guide.

These and other features and advantages of the present invention will become better understood with reference to the following brief and detailed descriptions of the drawings.

DETAILED DESCRIPTION OF THE DRAWINGS

Figure 1:
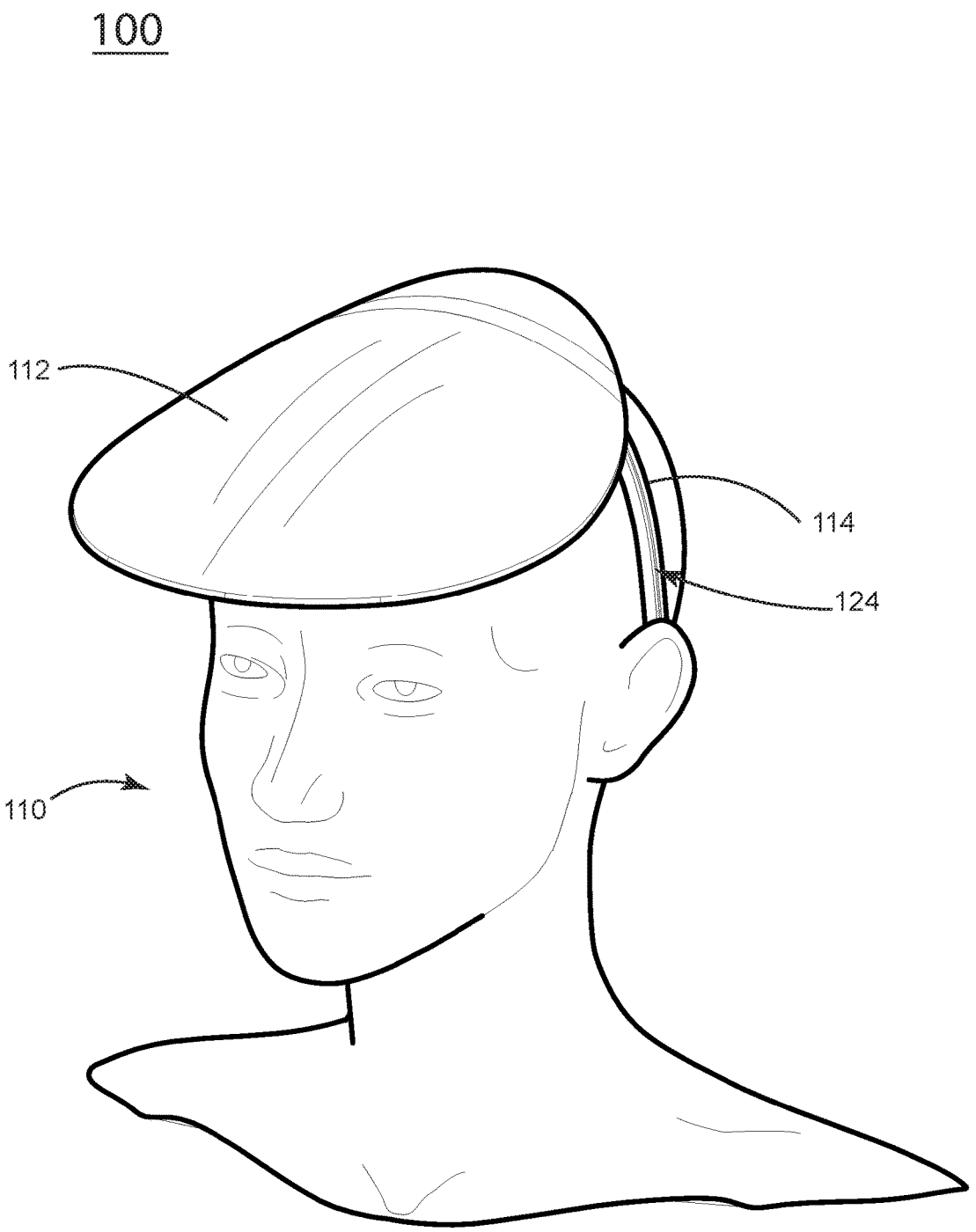
FIG. 1 is a front perspective view of an example embodiment the present disclosure as worn on the head.

FIG. 1 is an illustration depicting an example embodiment 100 having a semi-circular band, otherwise referred to a U-shaped band or a headband 114, worn on the user's head 110. A visor 112 is any piece of material that provides a surface for shading the sun from the face and neck. This surface piece, otherwise referred to as a visor is engaged with the headband 114 by way of a sliding, coupling (shown in FIG. 2 and FIG. 3). This sliding coupling has a bracket that engages with a groove 124 in the headband 114. One skilled in the art is familiar with headbands that are sometimes made of spring-steel covered with softer material such as padded fabric. Other headbands are made of flexible polymers that have the ability to return to their original shape, such polymers are said to have shape-memory. Some shape-memory polymers include nylon, high-density polyethylene and the like.

Figure 2:
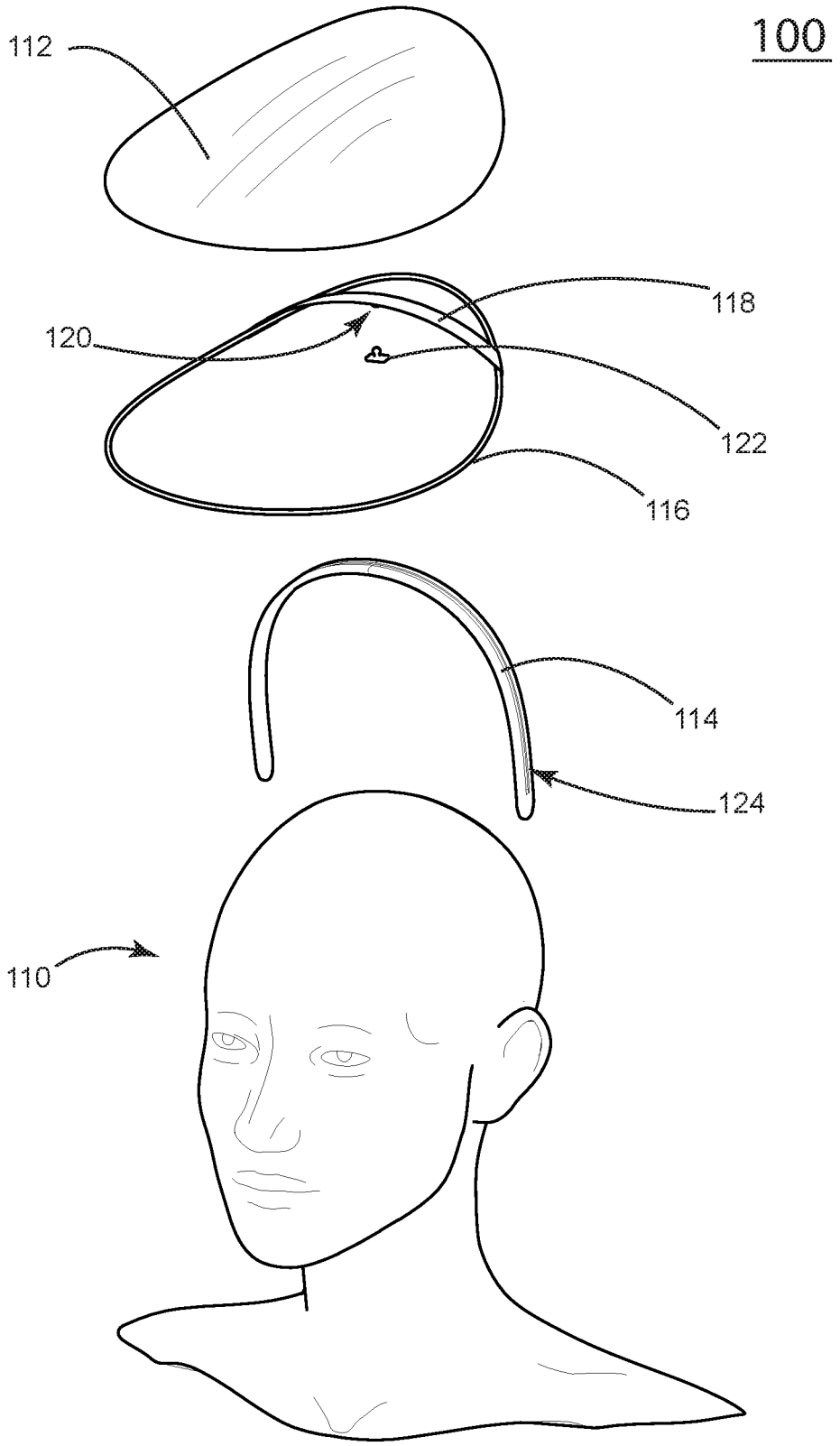
FIG. 2 is a perspective, exploded view of an example embodiment.

The illustration in FIG. 2 depicts an exploded view of an example embodiment 100 comprising a headband 114, a bendable, flexible structure 116, the flexible structure further comprising a cross member 118 that supports a ball-joint socket 120 for engaging a ball 122 that is configured to slide in a groove 124 in the headband 114. The structure 116 supports a fabric cover, also referred to as a visor 112. One skilled in the art will understand that a similar structure to structure 116 may be covered with any number of membrane materials having ultra-violet light blocking properties.

Figure 3:
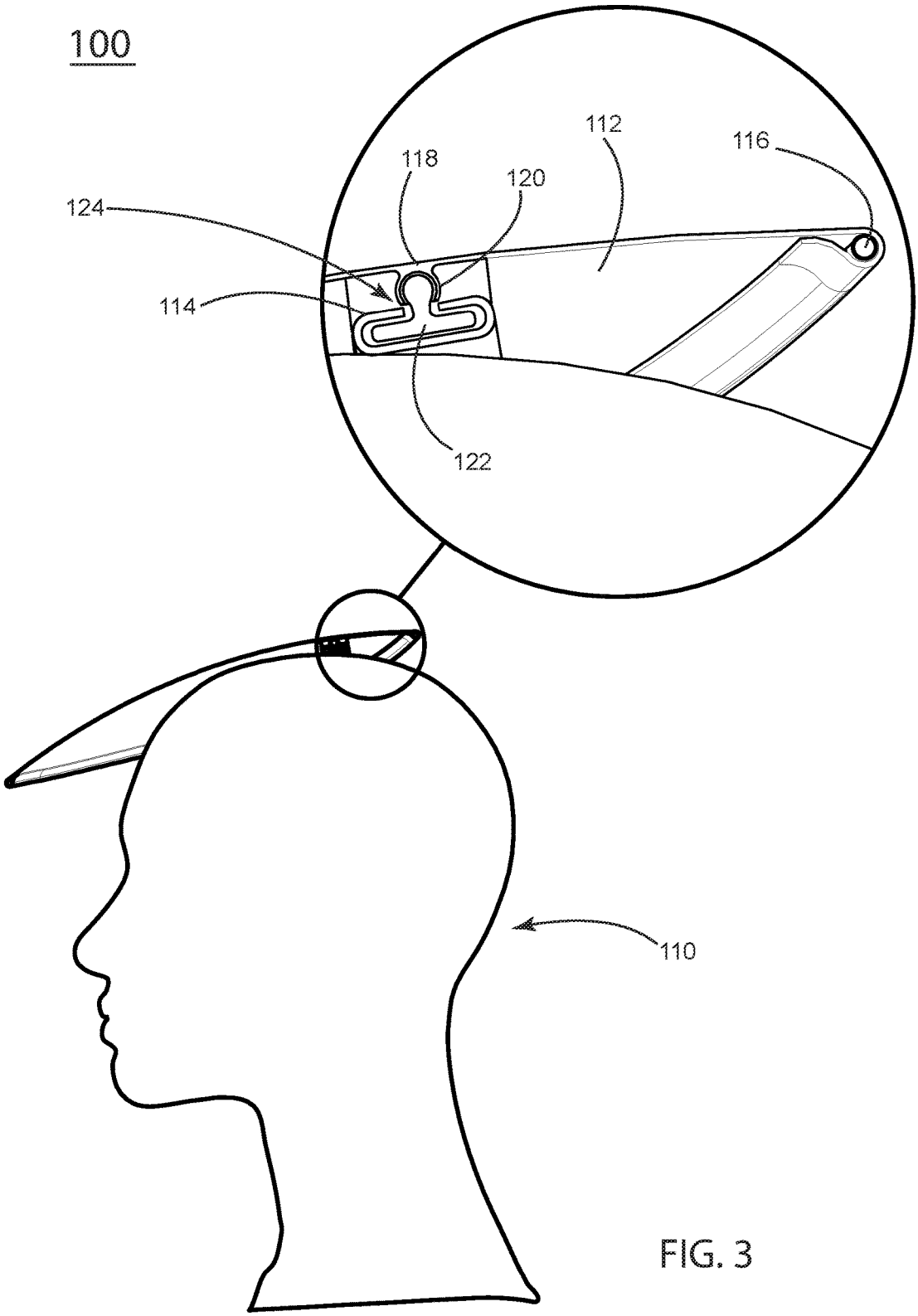
FIG. 3 is a detailed, cross section view of an exemplary embodiment.

The illustration in FIG. 3 is a cross section view of an example embodiment 100 depicting the configuration and engagement of the respective components. The headband 114 is worn on the head 110. The structure 116 is engaged with the edge of the visor 112 and may be affixed to the edge with adhesive, or may be sewn in to a hem as shown in the detailed view (FIG. 3). The ball joint 122 has a ball shape that fits into the ball joint socket 120 which is fixedly engaged with the structural cross member 118 that is further engaged with the structure 116. The ball joint 122 is further slidably engaged with the groove 124 in the headband 114. One skilled in the art will be familiar with ball joints and sliding mechanisms and the like and will further understand that any number of linear motion guides or slides may be used in place of or in conjunction with the aforementioned embodiment.

Figure 4:
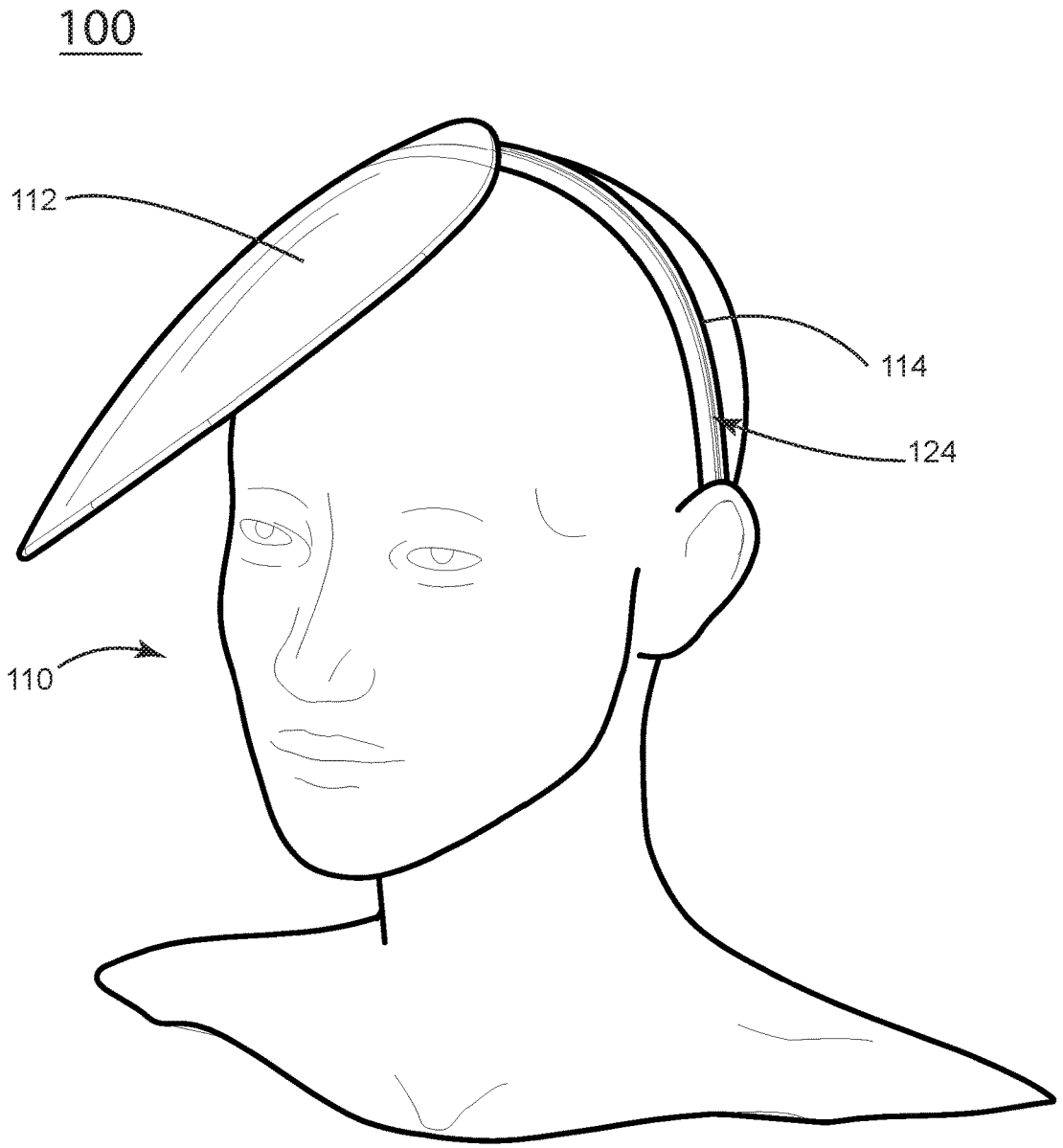
FIG. 4 is a front perspective view of an example embodiment the present disclosure as worn on the head.

The illustration in FIG. 4 depicts the example embodiment 100 as worn on the head, with the visor 112 and the ball joint (not visible) slid along the groove 124 of the headband 114 and pivoted about the ball 122 and socket 120 combination such that the visor covers the right side of the head 110. One skilled in the art will understand the numerous positions that the visor 112 may be moved to according to the function of the described configuration.

Figure 5:
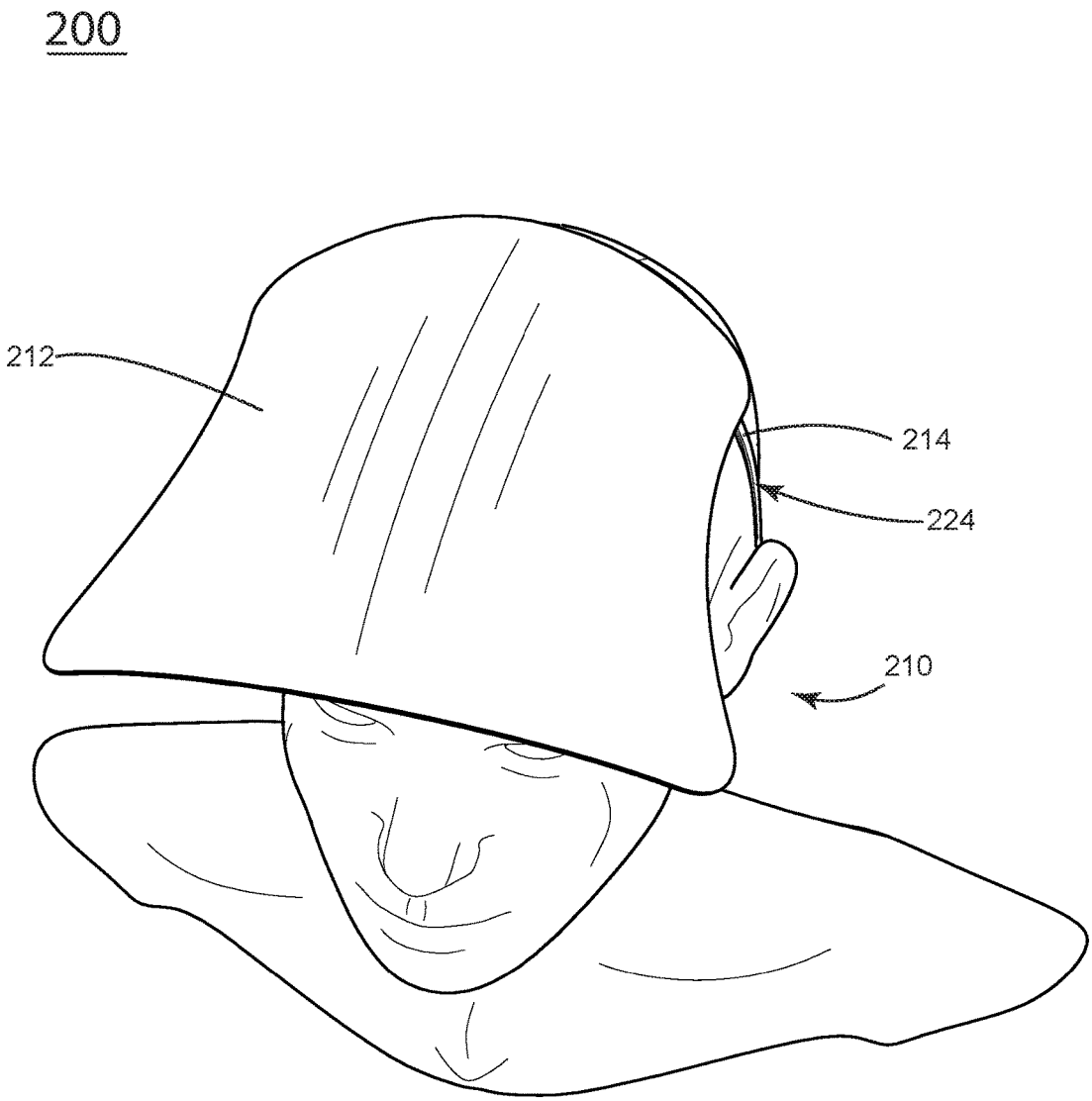
FIG. 5 is a perspective view of an iteration of the embodiment.

FIG. 5 is an illustration depicting an example embodiment 200 having a headband 214, worn on the user's head 210. A visor 212 is engaged with the headband 214 by way of a sliding, coupling (shown in FIG. 6 and FIG. 7) that engages with a rail 222 (FIG. 6, FIG. 7) and a groove 224 in the headband 214.

Figure 6:
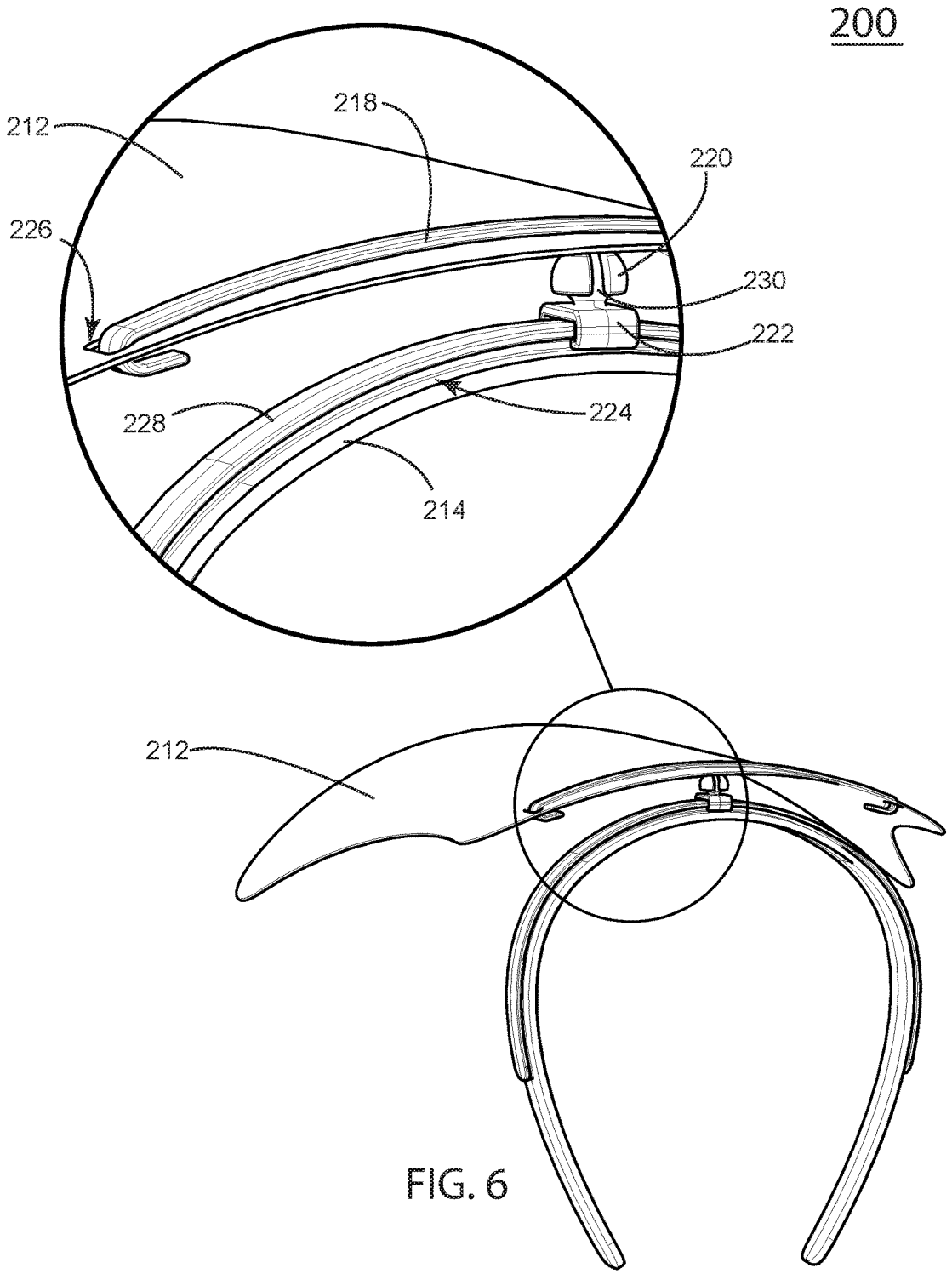
FIG. 6 is a detailed, view of the iteration of FIG. 5.

The illustration in FIG. 6 depicts a detail view of an example embodiment 200 comprising a headband 214, and a support structure 218. The structure 218 supports a ball joint socket 220 for engaging a ball 230 that is formed cohesively with a bracket 222 that is configured to slide along a rail 228 with tabs that slide in a groove 224 under the rail 228. The structure 218 snaps into holes 226 in the visor 212. One skilled in the art will understand such a visor may be made of semi-rigid plastic capable of holding the form shown while providing sufficient structure to support the structure 218 and may be made of any number of semi-rigid membrane materials having ultra-violet light blocking properties.

Figure 7:
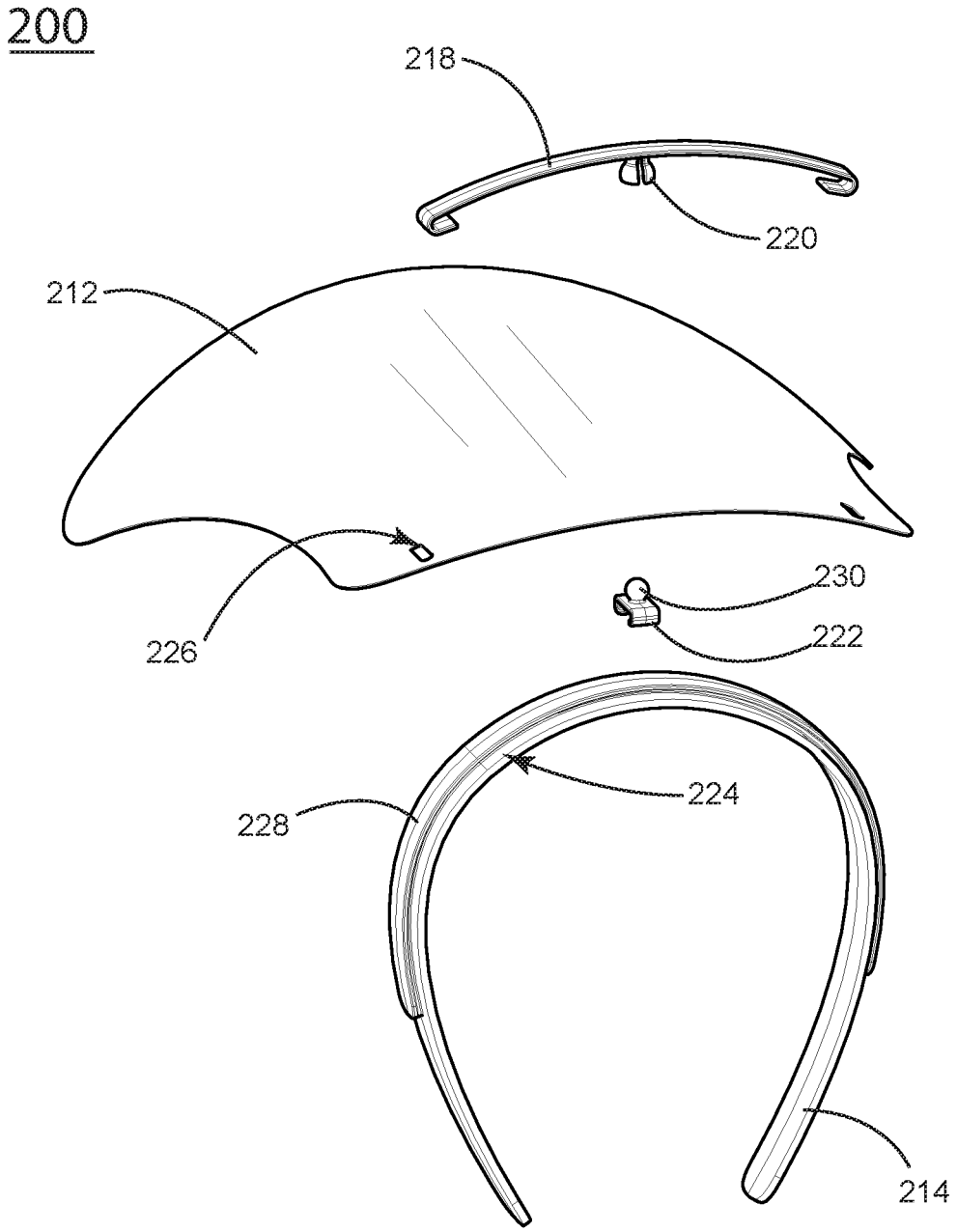
FIG. 7 is an exploded view of the iteration of FIG. 5.

The illustration in FIG. 7 is an exploded view of the example embodiment 200 depicting the configuration and engagement of the respective components. The headband 214 has a rail 228 along a substantial portion of the headband 214. The structure 218 is engaged with the visor 212 by insertion of a portion of the structure through holes 226 in the visor 212. A ball-joint has a ball 230 that fits into the ball-joint socket 220 which is fixedly engaged with the structure 218. The ball 230 is fixedly engaged with a bracket 222 that slides on a rail 228 with tabs that fit in a groove 224 in the headband 214. One skilled in the art will be familiar with ball joints and sliding mechanisms and the like and will further understand that any number of linear motion guides or slides may be used in place of or in conjunction with the aforementioned embodiment.

Figure 8:
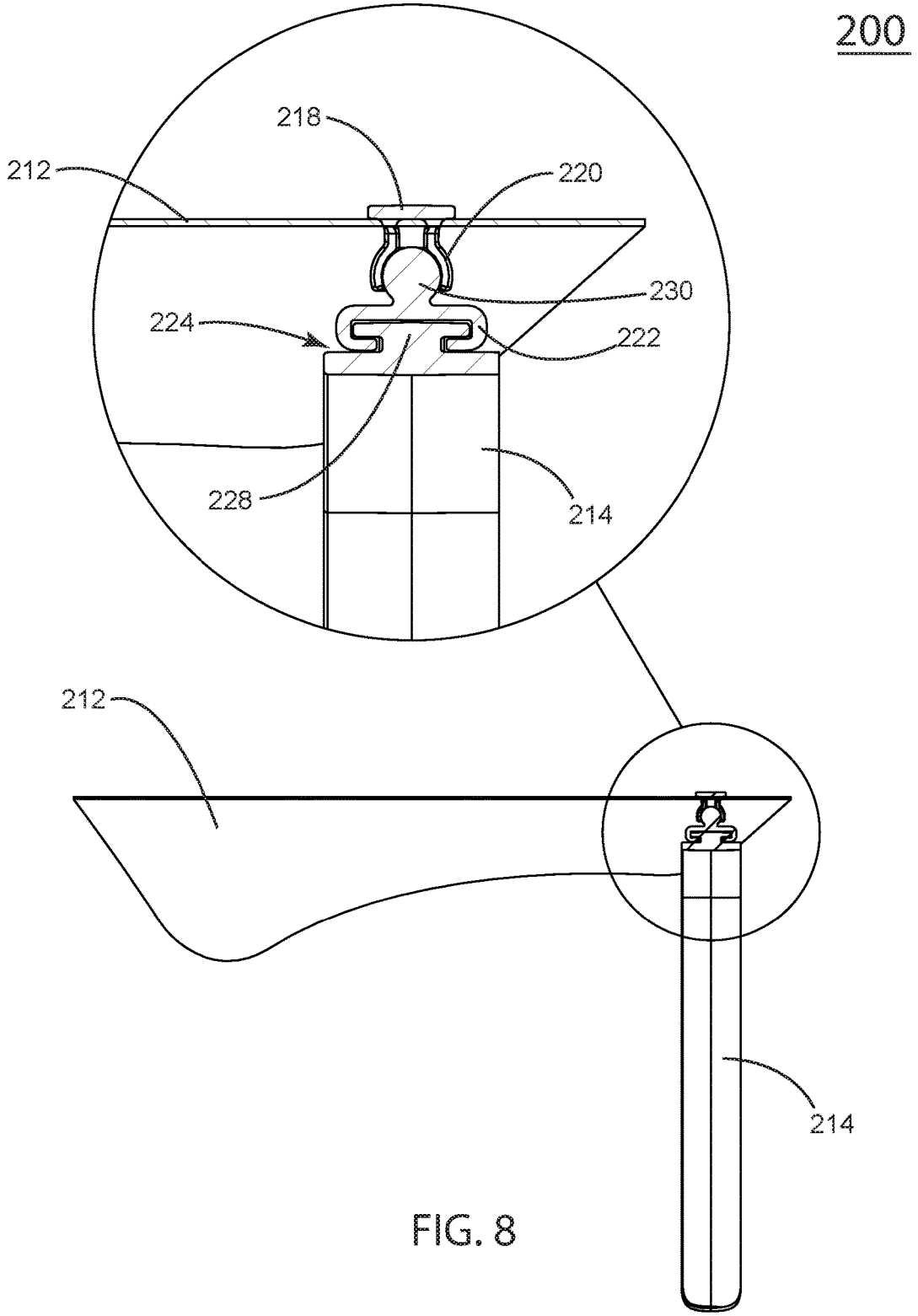
FIG. 8 is a detailed cross section view of the iteration of FIG. 5.

FIG. 8 is an illustration depicting a cross section of the example embodiment 200. One skilled in the art understands the manner in which the structure 218 is engaged with the ball-joint socket 220 while also engaged with the visor 212. The ball 230 is rotatably engaged with the ball joint socket 220 and further engaged with the bracket 222 that is slidably engaged with the rail 228 and the groove 224. The rail is fixedly engaged with the headband 214. One skilled in the art understands how this system may be used to position the visor 212 about the headband 214 and tilt the visor about the ball joint 220/230 to a range of angles.

Figure 9:
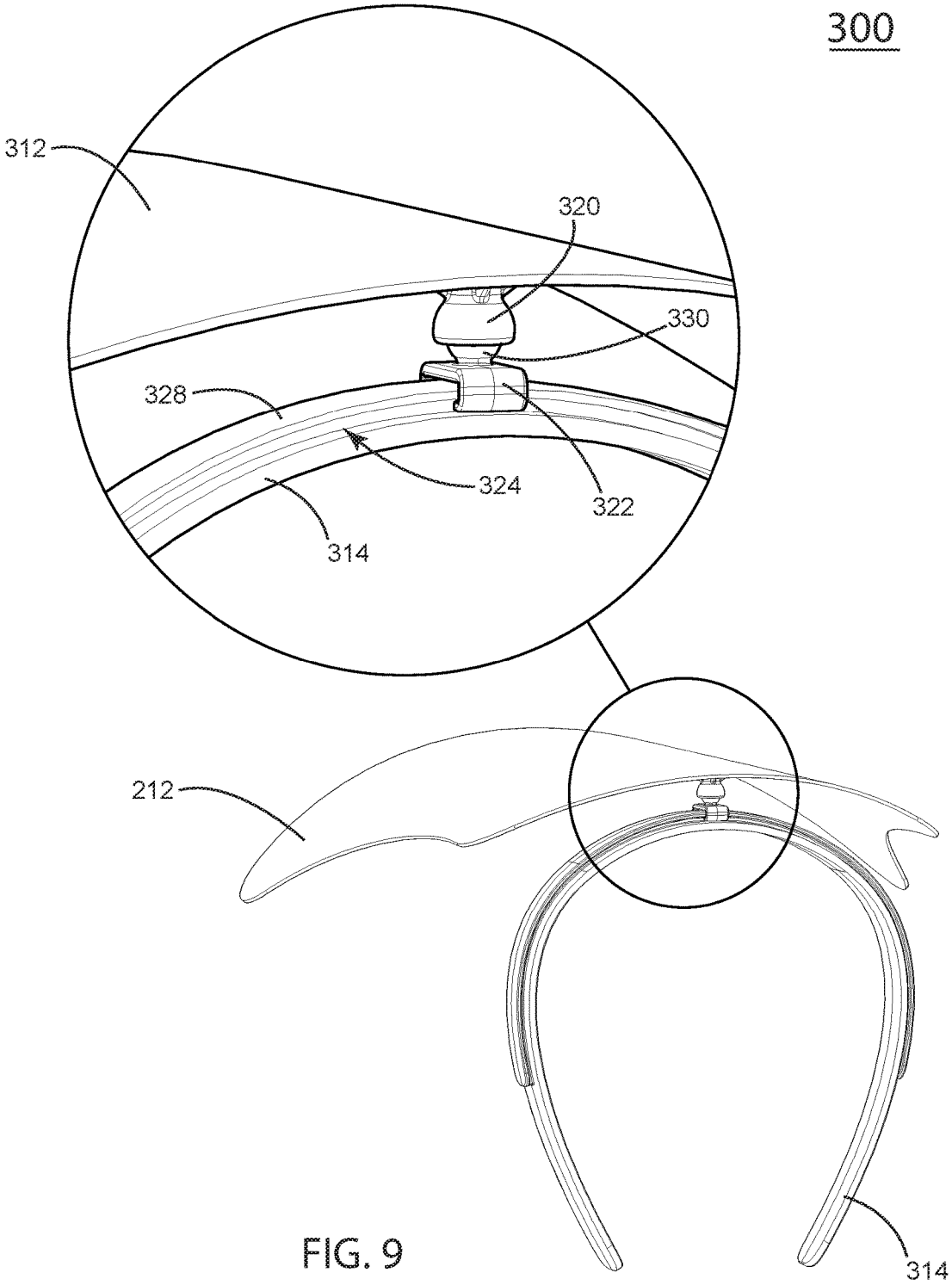
FIG. 9 is a detailed, view of an iteration of the embodiment.

The illustration in FIG. 9 depicts a detail of an example embodiment 300 comprising a headband 314 that is of a material that has sufficient structure to support a ball joint socket 320 that is for engaging a ball 330 that is formed cohesively with a bracket 322, configured to slide along a rail 328 with tabs that slide in a groove 324 under the rail 328. One skilled in the art will understand such a visor may be made of semi-rigid plastic or similar material capable of holding the form shown while providing sufficient structure to support the ball-joint socket 230 and may be made of any number of semi-rigid membrane materials having ultra-violet light blocking properties.

Figure 10:
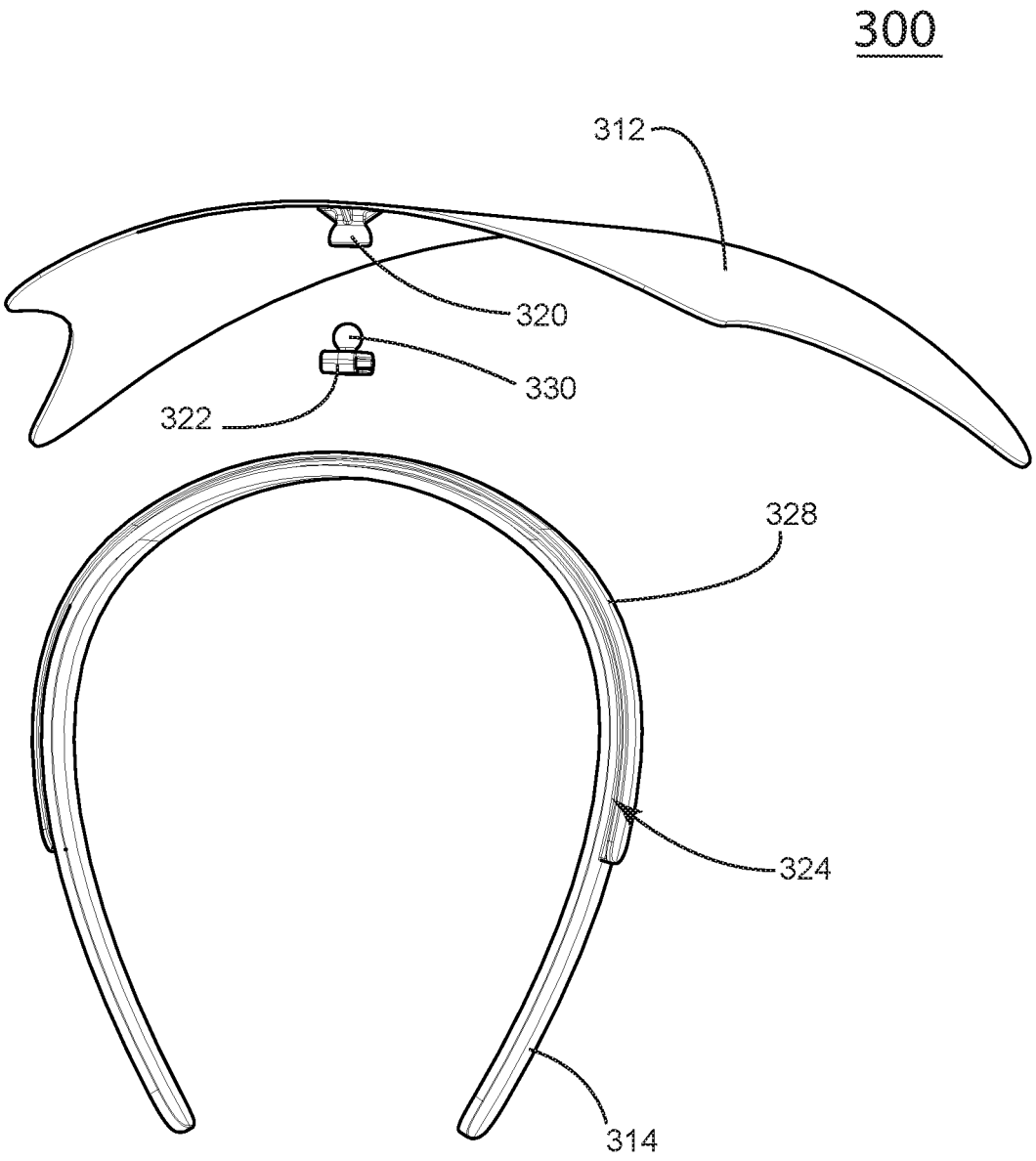
FIG. 10 is an exploded view of the iteration of FIG. 9.

The illustration in FIG. 10 is an exploded view of the example embodiment 300 depicting the configuration and engagement of the respective components. The headband 314 has a rail 328 along a substantial portion of the headband 314. A ball-joint has a ball 330 that fits into the ball joint socket 320 which is fixedly engaged with the visor 312. The ball 330 is fixedly engaged with a bracket 322 that slides on a rail 328 with tabs that fit in a groove 324 in the headband 314. One skilled in the art will be familiar with ball-joints and sliding mechanisms and the like and will further understand that any number of linear motion guides or slides may be used in place of or in conjunction with the aforementioned embodiment.

Figure 11:
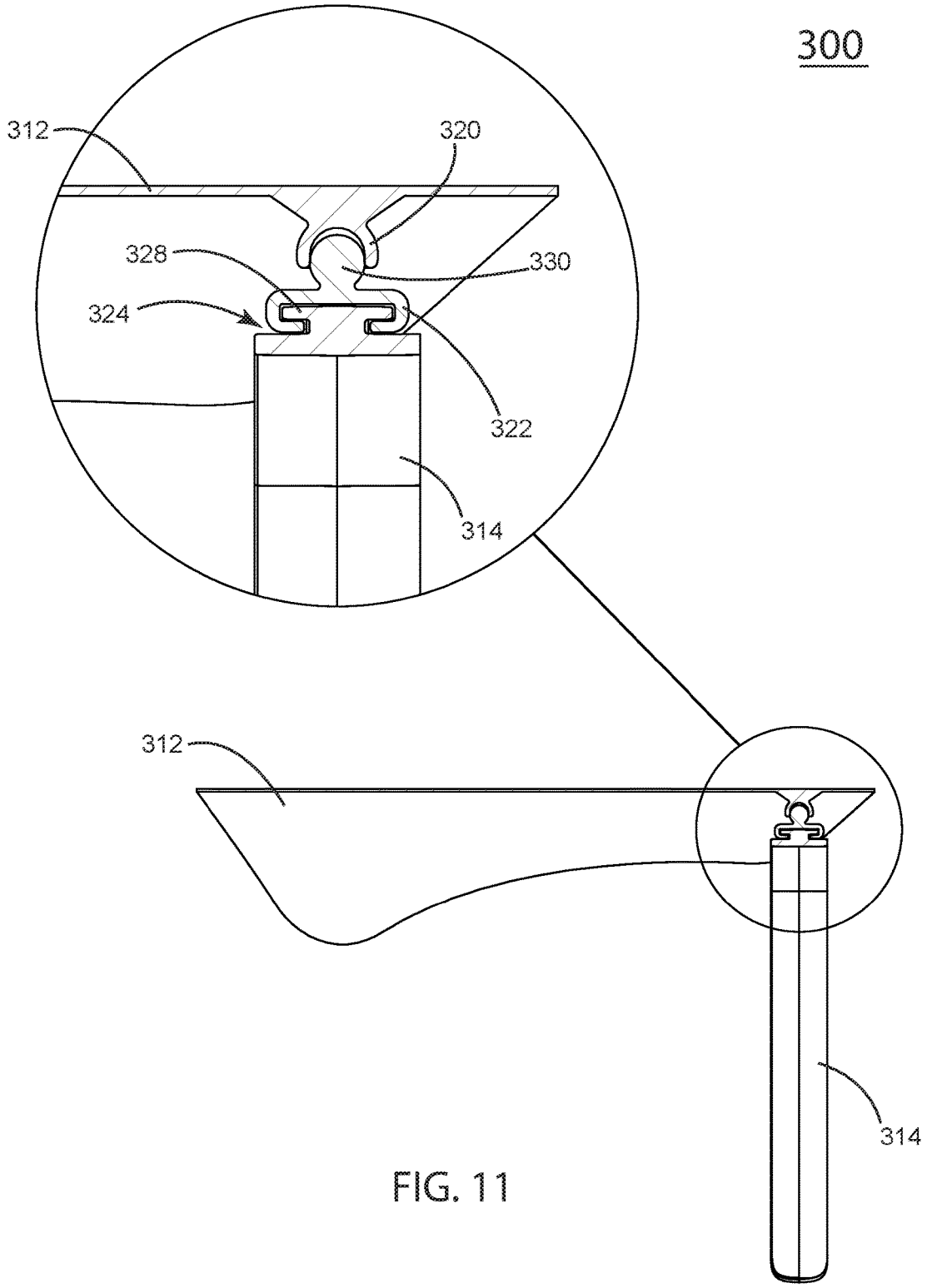
FIG. 11 is a detailed cross section view of the iteration of FIG. 9.

FIG. 11 is an illustration depicting a cross section of the example embodiment 300. One skilled in the art understands the manner in a ball-joint socket 320 may be molded or otherwise engaged with the visor 312. The ball 330 is rotatably engaged with the ball joint socket 320 and further molded cohesively with or otherwise engaged with the bracket 322 that is slidably engaged with the rail 328 and the groove 324. The rail is fixedly engaged with the headband 314. One skilled in the art understands how this system may be used to position the visor 312 about the headband 314 and tilt the visor about the ball joint 320/330 to a range of angles. One of ordinary skill in the art will recognize that additional embodiments are also possible without departing from the teachings of the presently disclosed subject matter. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and can be made without departing from the spirit and scope of the presently-disclosed subject matter.

The invention claimed is:

1. An apparatus for shading the face and neck of a user of the apparatus from the sun comprising:
- a semi-circular band; and
- a surface piece for shading the face and neck; and
- a mechanism engaged with said semi-circular band and with said surface piece; and
- said mechanism further comprising:
  - a ball joint having a ball and socket; and
  - a linear motion guide fixedly engaged with said semi-circular band; and
  - a bracket slidably engaged with said linear motion guide and fixedly engaged with said ball; and
- said socket fixedly engaged with said surface piece; and said ball rotatably engaged with said socket and said bracket slidably engaged with said linear motion guide; wherein
- said semi-circular band is worn on the head while said mechanism provides linear motion of said bracket and hence said surface piece, while said ball and socket provide rotational motion of the surface piece for shading select portions of the head and neck.

2. The apparatus of claim 1, the surface piece further comprising:
- a rigid frame; and
- a membrane stretched over said rigid frame; and
- said rigid frame comprising an edge structure and a cross member; wherein
- said edge structure supports the membrane about an outer edge of said surface piece while said cross member provides a structure with which said socket is fixedly engaged with.

3. The apparatus of claim 1 wherein said linear motion guide comprises a T-shaped slot in the semi-circular band: and said bracket comprises a T-shaped form that slides in said T-shaped slot.

4. The apparatus of claim 1, the semi-circular band comprising a spring-steel band covered with padded fabric.

5. The apparatus of claim 1, the semi-circular band is comprised of a shape-memory nylon material.

6. An apparatus for shading the face and neck of a user of the apparatus from the sun comprising:

a semi-circular band; and a surface piece for shading the face and neck; and a structural member removably engaged with said surface piece; and a mechanism engaged with said semi-circular band and with said structural member; and said mechanism further comprising:

a ball joint having a ball and socket; and a linear motion guide fixedly engaged with said semi-circular band; and a bracket slidably engaged with said linear motion guide and fixedly engaged with said ball; and said socket fixedly engaged with said structural member; and said ball rotatably engaged with said socket and said bracket slidably engaged with said linear motion guide; wherein said semi-circular band is worn on the head while said mechanism provides linear motion of said bracket and hence said structural member and in turn, said surface piece, while said ball and socket provide rotational motion of the structural member and hence said surface piece for shading select portions of the head and neck.

7. The apparatus of claim 6, the surface piece is comprised of a semi-rigid polymer material having slots for removable engagement of said structural member.

8. The apparatus of claim 6, the surface piece is comprised of a semi-rigid high-density polyethylene.

9. The apparatus of claim 6, the surface piece is comprised of a semi-rigid nylon.

10. An apparatus for shading the face and neck of a user of the apparatus from the sun comprising:

a semi-circular band; and a surface piece for shading the face and neck; and a mechanism engaged with said semi-circular band and with said surface piece; and said mechanism further comprising:

a ball joint having a ball and socket; and a linear motion guide fixedly engaged with said semi-circular band; and said linear motion guide being a T-shaped protrusion; and a bracket slidably engaged with said linear motion guide and fixedly engaged with said ball; and said bracket having a T-shaped through-hole for mating with said linear motion guide; and said socket fixedly engaged with said surface piece; and said ball rotatably engaged with said socket and said bracket slidably engaged with said linear motion guide; wherein said semi-circular band is worn on the head while said mechanism provides linear motion of said bracket and hence said surface piece, while said ball and socket provide rotational motion of the surface piece for shading select portions of the head and neck.

11. The apparatus of claim 10, the surface piece is comprised of a semi-rigid high-density polyethylene.

12. The apparatus of claim 10, the surface piece is comprised of a semi-rigid nylon.

* * * * *